US005291808A

United States Patent [19]

Buck

[11] Patent Number: 5,291,808

[45] Date of Patent: Mar. 8, 1994

[54] RING GEAR CAMMING MEMBER

[76] Inventor: David A. Buck, 1348 Sawmill Hwy., Breaux Bridge, La. 70517

[21] Appl. No.: 910,703

[22] Filed: Jul. 8, 1992

[51] Int. Cl.[5] ..... B25B 13/50; B25B 21/00

[52] U.S. Cl. ..... 81/57.18

[58] Field of Search ..... 81/57.15, 57.16, 57.18, 81/57.21, 57.33, 57.34, 57.2

[56] References Cited

U.S. PATENT DOCUMENTS

| | | | |
|---|---|---|---|
| 3,023,651 | 3/1962 | Wallace | 81/57 |
| 3,180,186 | 4/1965 | Catland | 81/57.18 |
| 3,380,323 | 4/1968 | Campbell | 81/54 |
| 3,589,742 | 6/1971 | Flick | 81/57.18 X |
| 3,847,040 | 11/1974 | Bufkin | 81/57.18 |
| 3,921,473 | 11/1975 | Boyadjieff et al. | 81/57.34 |
| 4,082,017 | 4/1978 | Eckel | 81/57.16 |
| 4,089,240 | 5/1978 | Eckel | 81/57.18 |
| 4,345,493 | 8/1982 | Rassieur | 81/57.34 |
| 4,402,239 | 9/1983 | Mooney | 81/57.16 |
| 4,576,254 | 3/1986 | Cox | 188/67 |
| 4,709,599 | 12/1987 | Buck | 81/57.18 |
| 4,716,794 | 1/1988 | Leppäner | 81/57.18 |

*Primary Examiner*—D. S. Meislin
*Attorney, Agent, or Firm*—Robert C. Tucker; William David Kiesel; C. Dean Domingue

[57] ABSTRACT

A camming member for power tongs, comprising a ring-shaped body including a central opening formed therein, the body being rotatable about a point within the central opening, the body further including a slot, the slot opening through the body and communicating with the central opening; a ring-shaped drive member including a central opening formed therein, the drive member being rotatable about the point, the drive member further including a slot, the slot opening through the drive member and communicating with the central opening of the drive member, the slot of the drive member being alignable with the slot of the body, the drive member being slidably mounted on the body such that the drive member may rotate independently of the body and such that the drive member is radially supported by the body; and a detent and stop mechanism, mounted on the camming member, for allowing the body and the drive member to partially rotate relative to one another to a desired engaged position and then to maintain the engaged position as the camming member rotates. Additionally, a the body of the camming member may also have a first cam surface facing the central opening and curving inward toward the point, and a second cam surface facing the central opening and curving inward toward the point, at least a portion of the second cam surface being axially aligned with and offset from the first cam surface.

8 Claims, 7 Drawing Sheets

RING GEAR CAMMING MEMBER

BACKGROUND OF THE INVENTION

1. Field of the Invention

This invention relates generally to devices known as "power tongs" which grip and rotate tubular members, such as drill pipe. More particularly, this invention relates to ring gear camming members contained within power tongs, which urge gripping jaws into contact with pipes.

2. Prior Art

Power tongs have been in existence for many years, and are generally employed in the oil and gas industry to grip and rotate tubular members, such as drill pipe. It is necessary to grip drill pipe with high compressive forces while applying a high degree of torque in order to break apart or tighten threaded pipe connections. In most cases, power tong designs employ a cam mechanism for converting a portion of the torque into a gripping (compressive) force normal to the pipe. This conversion is often accomplished utilizing a power driven ring gear having an interior cam surface. A cam follower (roller) on a jaw member rides upon the cam surface. As the ring gear is rotated, the follower (and thus the jaw member) is urged into contact with the pipe. An example of such an arrangement can be seen in U.S. Pat. No. 4,404,876.

Most current power tong designs include a ring gear camming member with an open slot or throat, through which the drill pipe is passed in order to place the power tong in position around the pipe. Some tong designs employ a ring gear camming member which has no open throat and is thus a solid circular member. However, a power tong with a solid ring gear camming member must be employed by passing it over the end of a pipe, since there is no open throat to facilitate installation. A power tong with a solid ring gear must be left in place around the pipe until conditions permit removal by sliding the tong off one end of the pipe.

Due to the tremendous forces generated during use, open throat power tongs must resist spreading during use. Prior art open throat tongs employ heavy duty rollers and other support structure to resist spreading. Despite such precautions, prior art tong often spread and fail during use, resulting in tremendous costs and down time during expensive drilling operations. While power tongs having solid circular camming members do not have the spreading problem, the versatility of open throat designs is much preferred.

Additionally, a particular power tong can only accommodate a relatively small range of pipe diameters for effective operation due to the sensitive response characteristics of the cam surfaces of the tong. This condition makes it necessary to have two or more power tongs available in order to accommodate a variety of pipe sizes encountered in drilling. In many cases, the additional weight and space requirements of extra power tongs are burdensome on drill rigs. This is especially true for offshore drilling situations.

SUMMARY OF THE INVENTION

Therefore, it is an object of this invention to provide an open throat camming member for power tongs which will not spread when in operation.

It is another object of this invention to provide such a camming member for power tongs which is easily adaptable to existing power tong designs.

It is a further object of this invention to provide a camming member for power tongs which is capable of accommodating multiple pipe sizes through the use of multiple cam surfaces.

Accordingly, a camming member for power tongs is provided, comprising a ring-shaped body including a central opening formed therein, the body being rotatable about a point within the central opening, the body further including a slot, the slot opening through the body and communicating with the central opening; a ring-shaped drive member including a central opening formed therein, the drive member being rotatable about the point, the drive member further including a slot, the slot opening through the drive member and communicating with the central opening of the drive member, the slot of the drive member being alignable with the slot of the body, the drive member being slidably mounted on the body such that the drive member may rotate independently of the body and such that the drive member is radially supported by the body; and a detent and stop mechanism, mounted on the camming member, for allowing the body and the drive member to partially rotate relative to one another to a desired engaged position and then to maintain the engaged position as the camming member rotates.

Additionally, a camming member for power tongs is provided, including a body having a central opening formed therein, the body being rotatable about a point within the central opening, the body further having a first cam surface facing the central opening and curving inward toward the point, and a second cam surface facing the central opening and curving inward toward the point, at least a portion of the second cam surface being axially aligned with and offset from the first cam surface.

DETAILED DESCRIPTION OF PREFERRED EMBODIMENTS OF THE INVENTION

Figure 1:
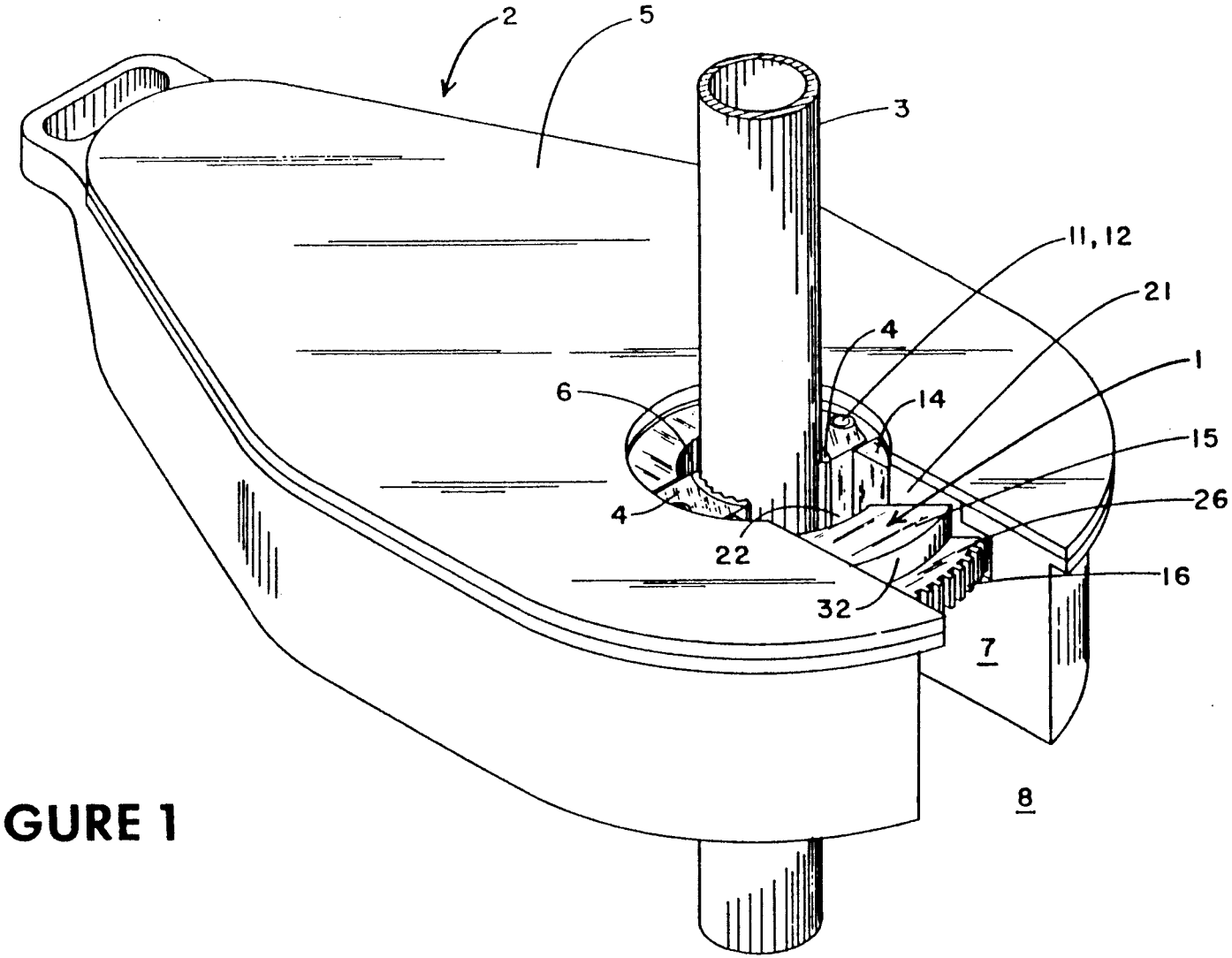
PRIOR ART FIGURE 1
FIG. 1 is a perspective view of a prior art power tong in place around a pipe.
Figure 2:
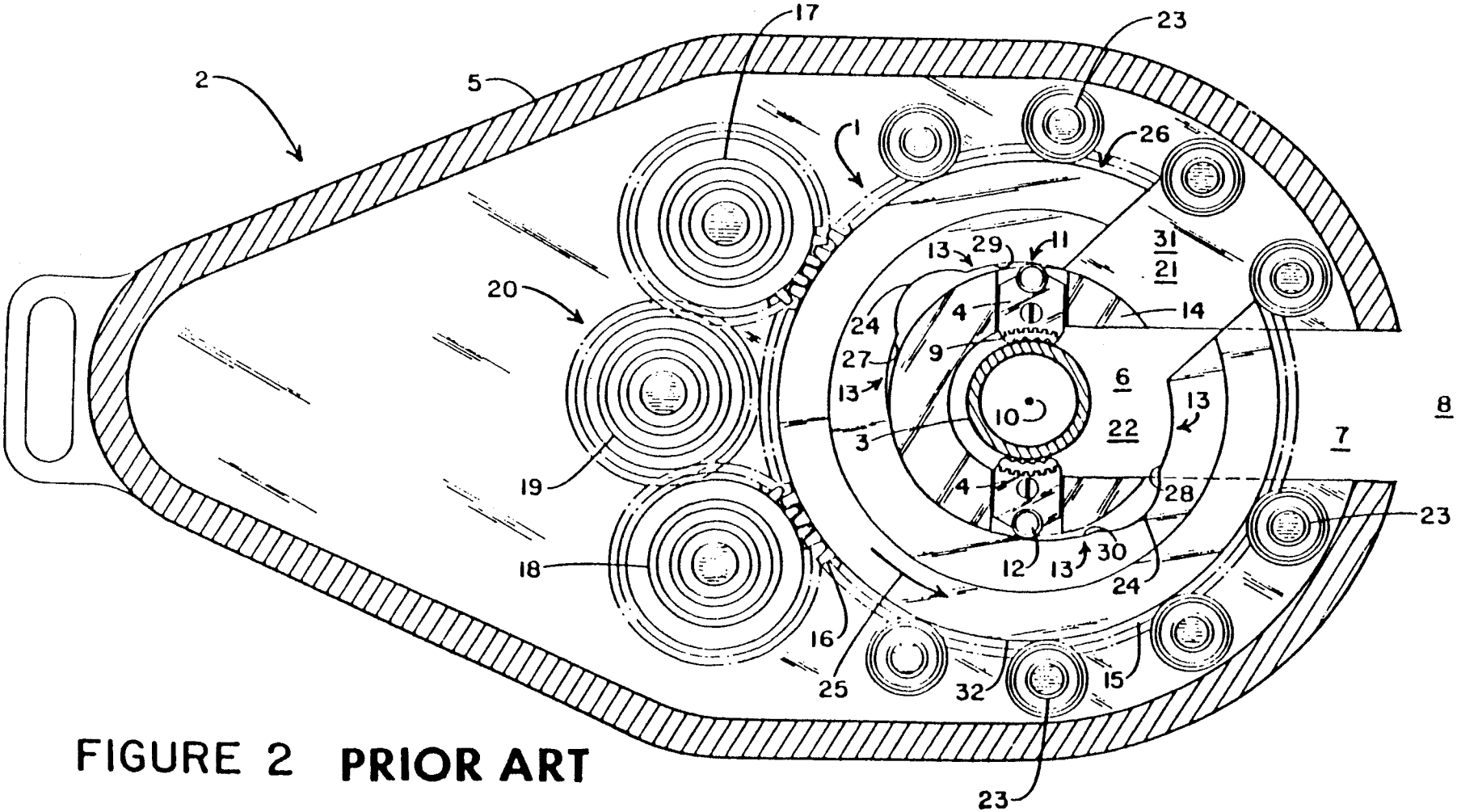
FIGURE 2 PRIOR ART
FIG. 2 is a cutaway top view of a prior art power tong.

As can be seen in FIGS. 1 and 2, a prior art camming member 1 is contained in a power tong 2, which engages a tubular member 3, such as a pipe, via jaw members 4 or other means known in the art. A typical power tong 2 comprises an enclosure structure 5, having a center opening 6 of sufficient size for a pipe 3 to pass therethrough, as shown. A slot 7 communicates between the exterior 8 of enclosure structure 5 and center opening 6, such that the power tong 2 can be placed around pipe 3 by passing pipe 3 through slot 7. Usually, a plurality of jaw members 4 are disposed within enclosure structure 5 such that jaw members 4 protrude into center opening 6. Each jaw member 4 preferably includes a gripping surface 9 facing toward a point, such as center point 10, within center opening 6. Various gripping surfaces 9 are known in the art, an example of which can be seen in U.S. Pat. No. 4,576,067 to David Buck. When pipe 3 is in place within the power tong 2, as shown in FIGS. 1 and 2, it is preferable that center point 10 be the center of rotation for the pipe 3. Thus, jaw members 4 are engageable with pipe 3 so as to rotate pipe 3 about a point such as center point 10. At least one jaw member 4 is provided with a cam follower 11, such as roller 12 or other means known in the art. Follower 11 rides on a cam surface 13 on camming member 1. As camming member 1 moves relative to follower 11, jaw member 4 is urged into contact with pipe 3 or releases from contact with pipe 3, depending upon the direction of movement. Usually, camming member 1 rotates while jaw members are maintained in a non-rotative position by jaw carrier 14 and a braking system (not shown). Jaw carrier 14 allows jaw members 4 to slide toward and away from center point 10.

Camming member 1 preferably comprises a ring gear 15, which is disposed within enclosure structure 5. However, camming member 1 can generally comprise a body 26 which rotates around a point, such as center point 10. Generally, as shown in FIGS. 1 and 2, cam surfaces 13 are disposed on either side of a pair of neutral surfaces 24. Cam surfaces 27 and 28 cause jaw members 4 to engage pipe 3 for clockwise rotation of camming member 1, and cam surfaces 29 and 30 cause pipe 3 to be engaged for counterclockwise rotation (as shown in FIG. 2 by rotation arrow 25). Neutral surfaces 24 provide a position for cam followers 11 when jaw members are retracted from pipe 3. Camming member 1 is driven by a means 20, engageable with camming member 1, for rotating camming member 1. Preferably, ring gear 15 is provided with teeth 16, which mesh with rotary idler gears 17 and 18, which are in turn driven by pinion idler gear 19. Pinion idler gear 19 is driven by a hydraulic drive (not shown) or other means known in the art. Gears 17, 18, 19 and hydraulic drive (not shown) are an example of means 20. Camming member 1 is substantially concentric with center opening 6, as shown, and is rotatable about center point 10. Camming member 1 is further provided with a means 31 for positioning pipe 3 in central opening 22, such as a slot 21, which is alignable with slot 7 such that pipe 3 can be received in central opening 22 of camming member 1. Rollers 23 are disposed within enclosure structure 5, and bear against and contain a smooth surface 32 on ring gear 15, providing resistance to spreading when jaw members 4 are engaged with pipe 3. An example of overall prior art ring gear construction can be seen in U.S. Pat. No. 3,180,186, FIG. 8 at 40. As can be seen, if forces cause camming member 1 to spread, rollers 23, means 20 and other support structures of the power tong 2 can be severely damaged, rendering the power tong 2 useless.

FIGS. 3–12 depict improved embodiments of the ring gear camming member 1 shown in FIGS. 1 and 2. The improved camming member of this invention is referred to in FIGS. 3–12 by the numeral 50, while the features common to prior art camming member 1 are referred to with the same numerals as in FIGS. 1 and 2. It will become evident that embodiments of the improved camming member 50 may be used to simply replace some prior art camming members 1. However, it is preferable that new power tongs 2 be constructed in which the enclosure structure 5 is of less bulk and weight than the prior art, due to the lack of propensity of the improved camming member 50 to spread when loaded.

Figure 3:
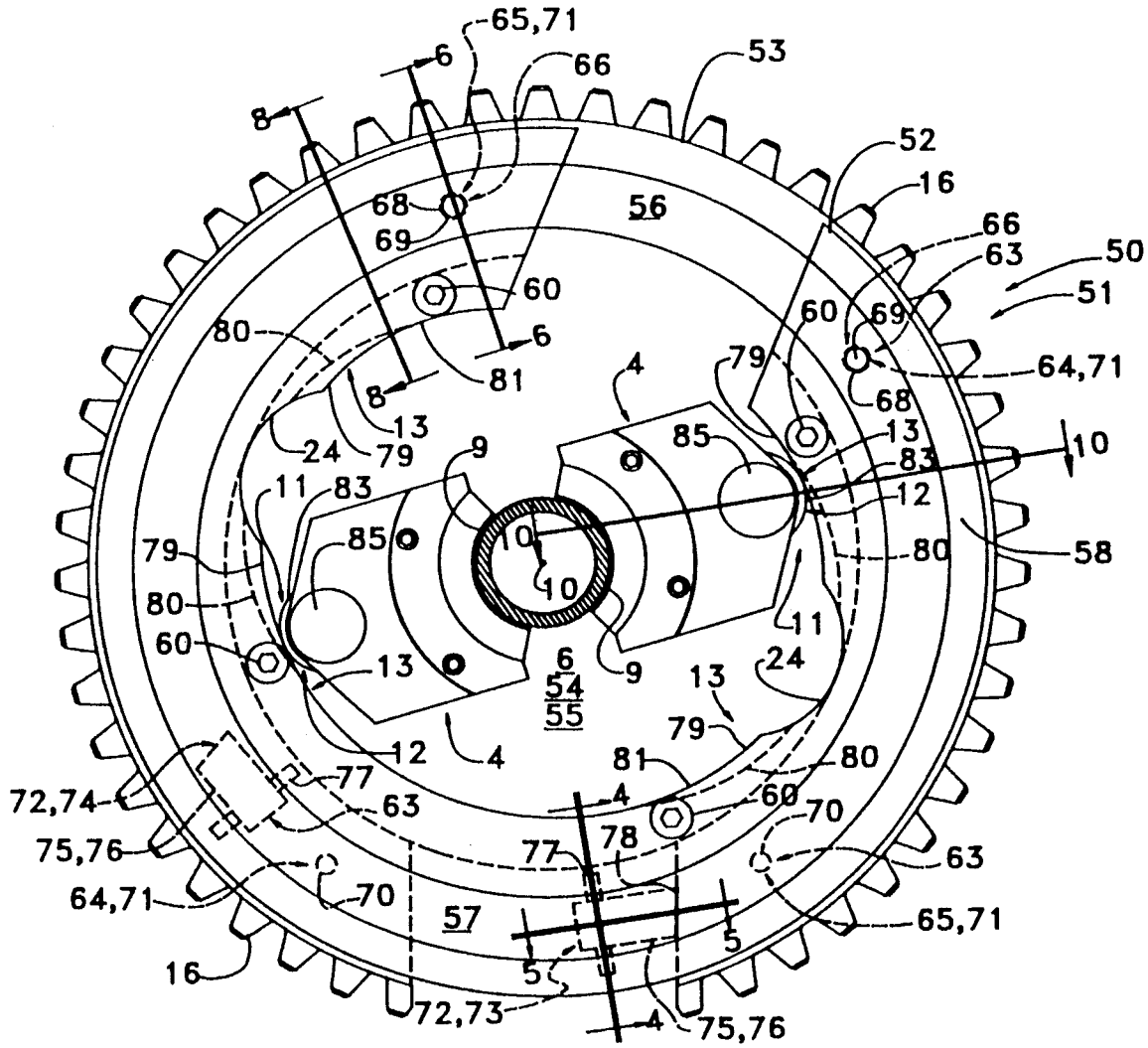
FIG. 3 is a top view of a preferred embodiment of the camming member of this invention in an engaged position around a pipe.
Figure 5:
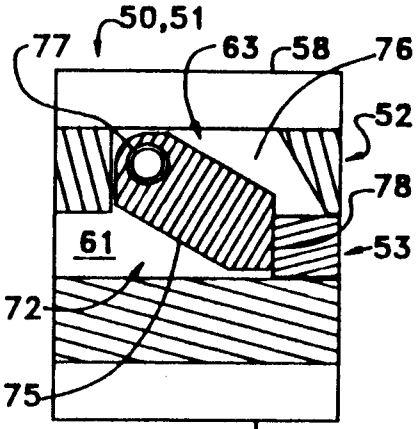
FIG. 5 is a sectional view taken along section line 5—5 of FIG. 3.
Figure 4:
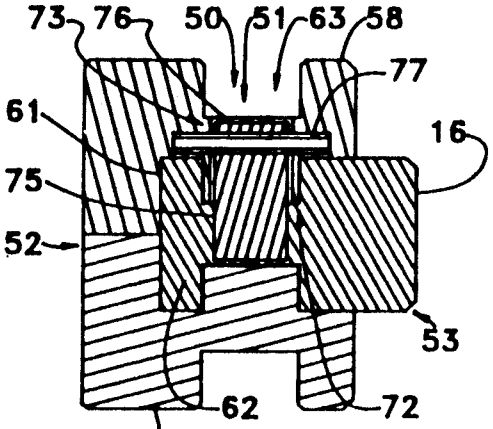
FIG. 4 is a sectional view taken along section line 4—4 of FIG. 3.
Figure 9:
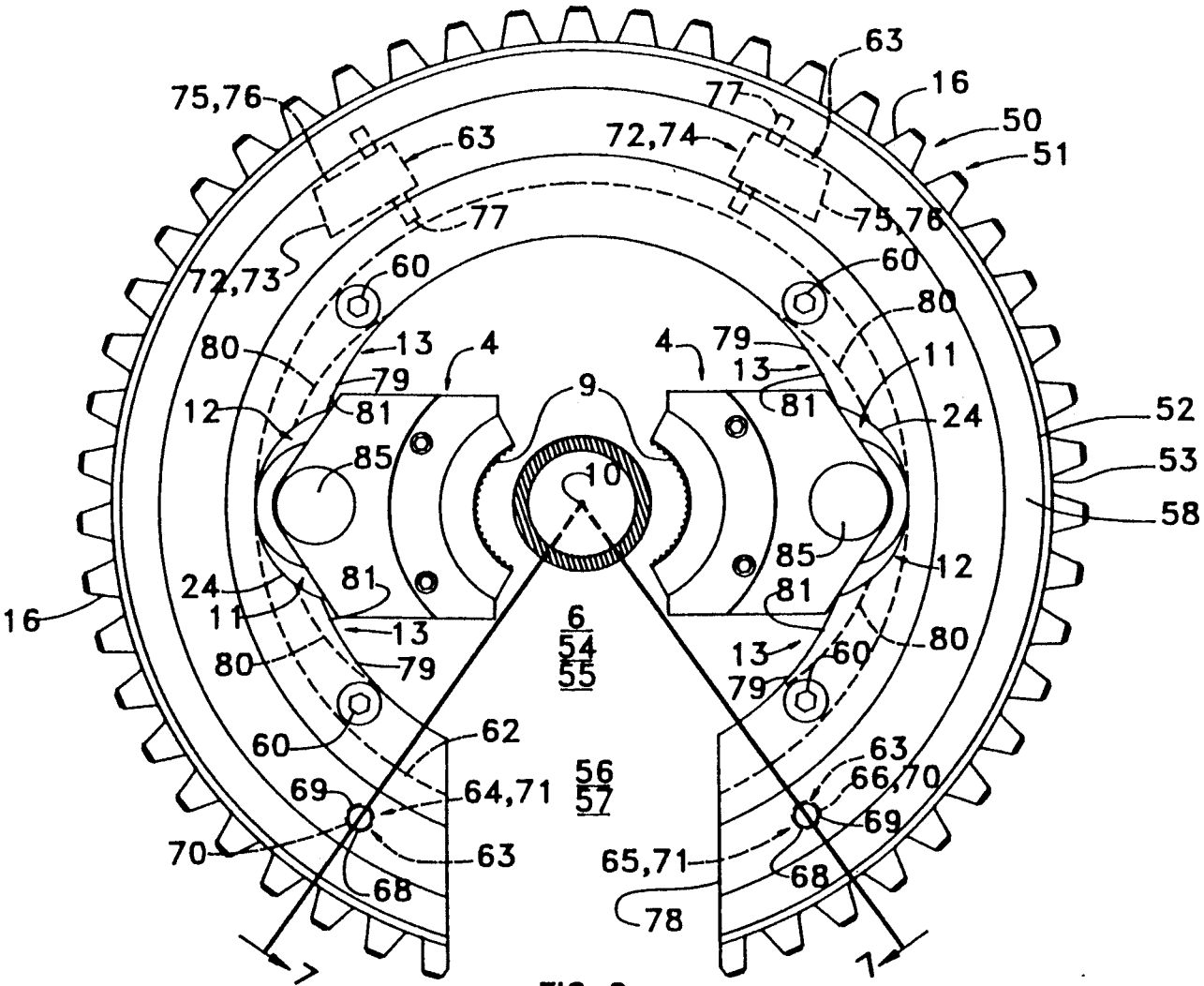
FIG. 9 is a top view of a preferred embodiment of the camming member of this invention in an open position around a pipe.

Preferably, improved camming member 50 takes the form of a ring gear 51 having an overall appearance very similar to that of prior art ring gears 15. Camming member 50 is driven by torque applied to gear teeth 16, which turn ring gear 51, urging rollers 12 to move along cam surfaces 13, in turn urging jaw members 4 into pipe 3. Camming member 51 generally comprises a ring-shaped body 52, having central opening 54, and a ring-shaped drive member 53, having central opening 55. Body 52 is provided with a slot 56 which opens through body 52 and communicates with central opening 54, as shown in FIGS. 3 and 9. Similarly, drive member 53 is provided with a slot 57 which opens through drive member 53 and communicates with central opening 55. Slot 56 is alignable with slot 57. Body 52 and drive member 53 are preferably concentric and rotatable about a point, such as center point 10. Drive member 53 is slidably mounted on body 52 such that drive member 53 may rotate independently of body 52, and such that drive member 53 is radially supported by body 52, thus preventing drive member 53 from spreading outward under load. In the embodiment shown, drive member 53 surrounds body 52, also providing a resistance to spreading of body 52. It is preferred that body 52 include a top portion 58 and a bottom portion 59, held together by bolts 60. Top portion 58 and bottom portion 59 cooperate to form a T-shaped channel 61, which slidably contains a T-shaped flange 62 of drive member 53. Channel 61 should be greased or otherwise lubricated to facilitate the sliding relationship between body 52 and drive member 53.

FIG. 3 depicts camming member 50 in a closed position, with jaw members 4 gripping pipe 3. FIG. 9 depicts camming member 50 is an open position, with jaw members 4 withdrawn from pipe 3 and slots 56 and 57 aligned. A means 63, mounted on camming member 50, is provided for allowing body 52 and drive member 53 to partially rotate relative to one another to a desired position and then to maintain the engaged position as camming member 50 rotates. In order to maintain slots 56 and 57 in alignment in order to insert or remove pipe 3, means 63 may include at least one detent means 71 for preventing body 52 and drive member 53 from rotating relative to each other, when slot 57 of drive member 53 is aligned with slot 56 of body 52, until body 52 imparts unto detent means 71 a threshold resistance to rotation.

Figure 7:
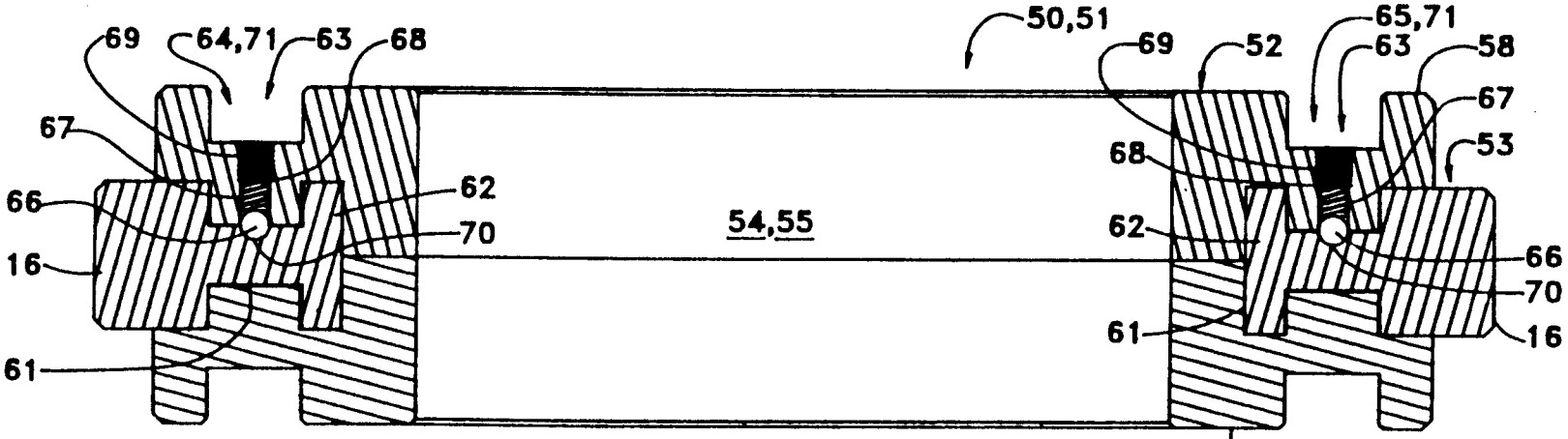
FIG. 7 is a sectional view taken along section line 7—7 of FIG. 9.
Figure 6:
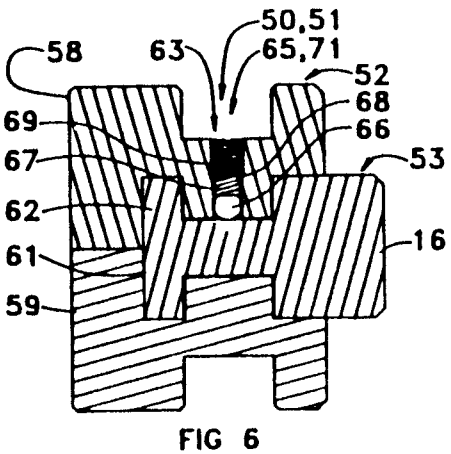
FIG. 6 is a sectional view taken along section line 6—6 of FIG. 3.

A section of the invention 50 is shown in FIG. 7, depicting two detent means 71, such as ball detents 64 and 65 in a seated position. Each detent 64,65 includes a ball 66 and spring 67, contained by a bore 68 in body 52 and by a threaded plug 69. Ball 66 rests in a dish-shaped seat 70 in drive member 53. Detents 64,65 are located such that, when balls 66 are seated on seats 70, both slots 56 and 57 are aligned. When enough resistance from rollers 12 on cam surfaces 13 is exerted on body 52, the force of springs 67 is overcome, balls 66 are forced out of seats 70 (as shown in FIG. 6) and drive member 53 rotates independently of body 52, rotating slots 56 and 57 out of alignment with each other.

Means 63 may also include at least one stop means 72 for preventing body 52 and drive member 53 from rotating relative to each other after body 52 and drive member 53 have rotated relative to each other to an engaged position. Stop means 72 preferably includes a pawl assembly 73,74 which includes a pawl 75 pivotally mounted in a pocket 76 in top portion 58 of body 52. Pin 77 pivotally supports pawl 73. Two pawl assemblies 73,74 are shown in the FIG. 3. Pawl assembly 73 prevents drive member 53 from rotating in the clockwise direction, and pawl assembly 74 prevents drive member 53 from rotating in the counterclockwise direction.

Operation of power tong 2 including improved camming member 50 is simple. Reference should here be made to FIGS. 3 and 9. Although no enclosure structure 5 is shown in FIGS. 3 or 9 for clarity, it should be assumed that the camming member 50 is contained within a typical enclosure structure 5 having a slot 7 as shown in FIGS. 1 and 2. In order to place camming member 50 around a pipe 3, slots 56 and 57 are aligned in the open position, as shown in FIG. 9. In the open position, both detents 64,65 are in seated position, as shown in FIG. 7. Detents 64,64 thus maintain the alignment of slots 56 and 57. Once the tong 2 is placed around the pipe 3, it is necessary to close slot 7. To do so, torque is applied to drive member 53 through teeth 16, rotating body 52 and drive member 53 as a unit, with detents 64,65 holding slots 56 and 57 in alignment. As camming member 50 rotates as a unit (clockwise in FIG. 3), rollers 12 climb onto cam surfaces 13 until jaw members 4 begin to grip pipe 3. At this point, body 52 begins to resist the rotative force being applied by drive member 53 through detents 64,65. When the resistance to rotation exceeds a threshold resistance, balls 66 will become unseated and drive member 53 will continue to rotate while body 52 remains stationary. The relative rotation between body 52 and drive member 53 occurs until slots 56 and 57 are no longer aligned. When slot 57 passes beneath pawl assembly 73, a pawl 75 drops into slot 57 and stops the relative rotation when it strikes the edge 78 of slot 57. At this point, camming member 50 completely surrounds pipe 3 and once more begins to rotate as a unit, applying the desired gripping pressure and torque to pipe 3, as shown in FIG. 3. As increased forces are applied to cam surfaces 13, camming member 50 resists spreading due to the radial support which body 52 and drive member 53 provide to each other.

Another feature of the improved camming member 50 is the ability to provide multiple cam surfaces which accommodate a greater variety of pipe sizes. While the two-piece construction of body 52 facilitates construction of the multiple cam surfaces of the invention, they may be easily machined on prior art one-piece ring gears. In one-piece designs, top portion 58 and bottom portion 59 of body 52, as well as drive member 53, could be formed as a single unitary body, such as body 26 shown in FIG. 2. As shown in FIGS. 8, 10, 11 and 12, body 52 includes a primary cam surface 79 and a secondary cam surface 80, located on either side of each neutral surface 24. Primary cam surfaces 79 and secondary cam surfaces 80 each face central opening 54 and curve inward toward a point, such as center point 10. The term "curve" as applied to the cam surfaces herein is intended to include any cam surface which approaches point 10 as body 52 is rotated. At least a portion of each secondary cam surface 80 is axially aligned with and axially offset from a primary cam surface 79. The term "axially" refers to a direction generally parallel to pipe 3. Thus, where only one cam surface formerly existed on either side of neutral surface 24, now a plurality of parallel primary and secondary cam surfaces 79,80 can accommodate alternate pipe sizes.

Figure 8:
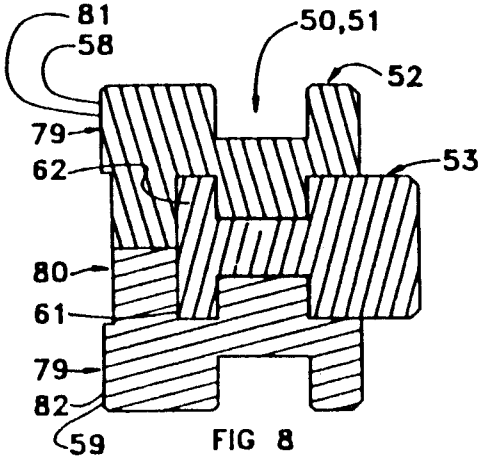
FIG. 8 is a sectional view taken along section line 8—8 of FIG. 3.
Figure 11:
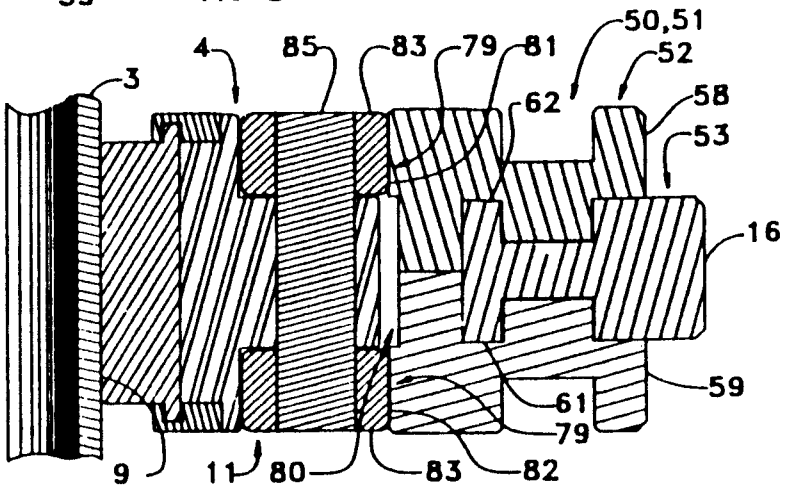
FIG. 11 is an alternate sectional view taken along section line 10—10 of FIG. 3 with a second jaw member in contact with one of the multiple cams of the invention.
Figure 10:
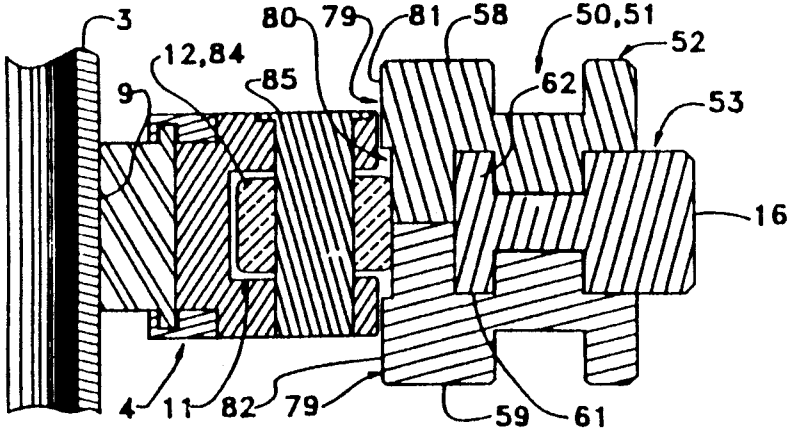
FIG. 10 is a sectional view taken along section line 10—10 of FIG. 3 with a first jaw member in contact with one of the multiple cams of the invention.
Figure 12:
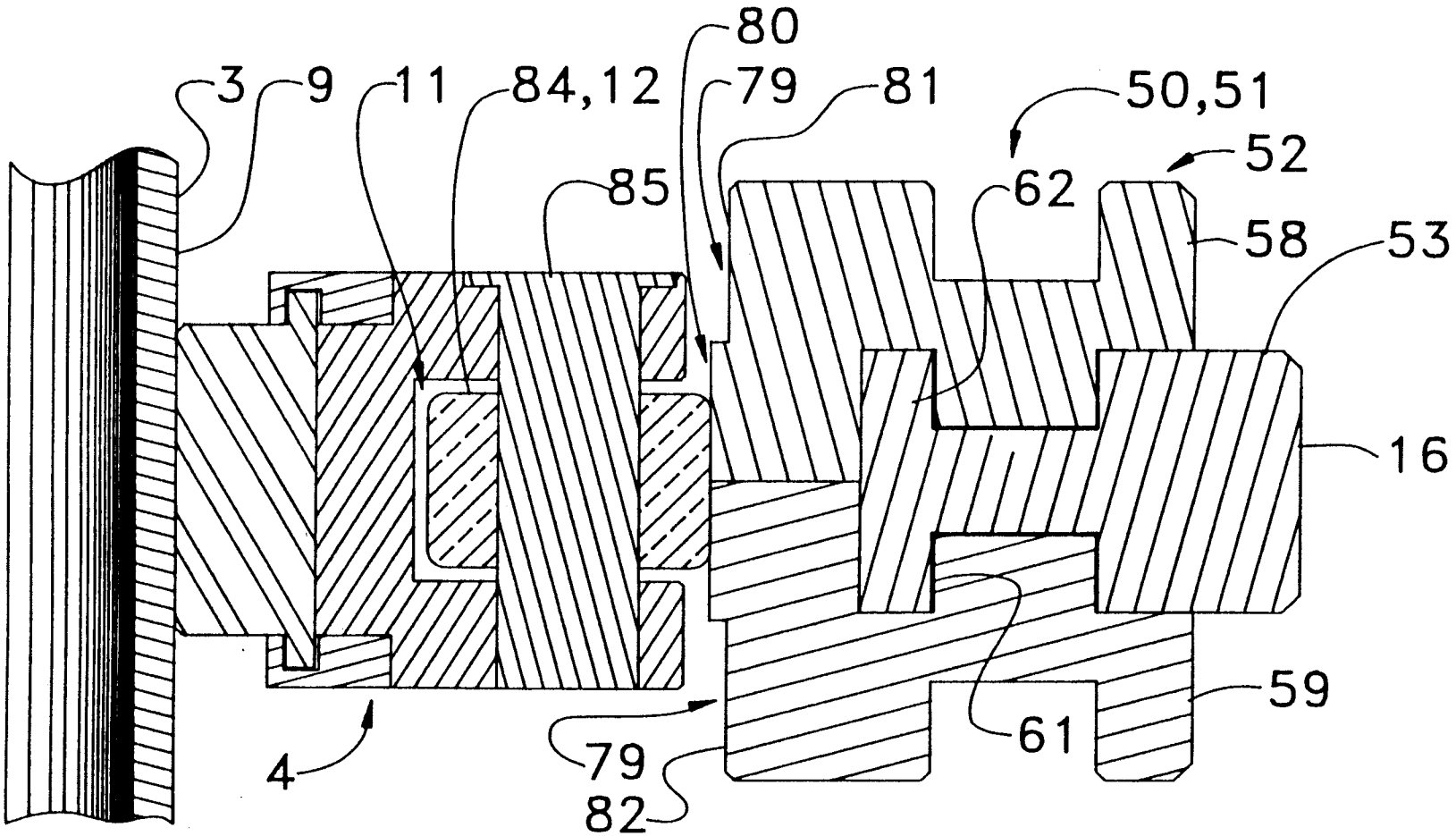
FIG. 12 is the same sectional view as FIG. 10, but illustrating an alternate arrangement of the multiple cam surfaces of the invention.

FIG. 8 illustrates a preferred embodiment of primary and secondary cam surfaces 79,80. Primary cam surface 79 is divided into an upper portion 81 and a lower portion 82. Secondary cam surface 80 is positioned in between upper portion 81 and lower portion 82, and will accommodate a wider spacing between opposing jaw members 4 when camming member 50 is used on larger pipe 3. As shown in FIG. 11, a jaw member 4 having a spaced rollers 83, held in place by roller pin 85, is employed when utilizing primary cam surface 79. When a larger pipe 3 is encountered, a jaw member 4 is substituted having a center roller 84 which is actuated by secondary cam surface 80, as shown in FIG. 10. FIG. 12 illustrates an alternate embodiment wherein the positions of primary and secondary cam surfaces 79,80 are reversed. Many other configurations are possible, including more than two axially aligned and offset cam surfaces 79,80. This design is only limited by the thickness of body 52.

An improved camming member 50 is thus provided which resists spreading, and which requires no exterior support against spreading, enabling a more versatile power tong 2 to be constructed. Further, improved camming member 50, with axially aligned and offset primary and secondary cam surfaces 79,80 will accommodate a wider range of pipe sizes with a single ring gear 51. Other embodiments of the invention will occur to those skilled in the art, and are intended to be included within the scope and spirit of the following claims.

I claim:

1. A camming member for power tongs, comprising:

a. a ring-shaped body including a central opening formed therein, said body being rotatable about a point within said central opening, said body further including a slot, said slot opening through said body and communicating with said central opening;

b. a ring-shaped drive member including a central opening formed therein, said drive member being rotatable about said point, said drive member further including a slot, said slot opening through said drive member and communicating with said central opening of said drive member, said slot of said drive member being alignable with said slot of said body, said drive member being slidably mounted on said body such that said drive member may rotate independently of said body and such that said drive member is radially supported by said body; and c. a means, mounted on said camming member, for allowing said body and said drive member to partially rotate relative to one another to a desired engaged position and then to maintain said engaged position as said camming member rotates.

2. A camming member for power tongs according to claim 1, wherein said body includes a top portion and a bottom portion, said top and bottom portions being fixedly attached to each other and cooperatively forming a channel, said channel slidably containing said drive member.

3. A camming member for power tongs according to claim 1, wherein said drive member is provided with an outer periphery including a plurality of gear teeth.

4. A camming member for power tongs according to claim 2, wherein said drive member is provided with an outer periphery including a plurality of gear teeth.

5. A camming member for power tongs according to claim 1, wherein said body is provided with at least one cam surface adjacent to said central opening.

6. A camming member for power tongs according to claim 5, wherein said means includes:

i. a detent means for preventing said body and said drive member from rotating relative to each other when said slot of said drive member is aligned with said slot of said body until said body imparts unto said detent means a threshold resistance to rotation; and ii. a stop means for preventing said body and said drive member from rotating relative to each other after said body and said drive member have rotated relative to each other to said desired position.

7. A camming member for power tongs according to claim 1, wherein said body is provided with a primary cam surface facing said central opening and curving inward toward said point, and a secondary cam surface facing said central opening and curving inward toward said point, at least a portion of said secondary cam surface being axially aligned with and axially offset from said primary cam surface.

8. A camming member for power tongs according to claim 9, wherein said primary cam surface includes an upper portion located above said secondary cam surface and a lower portion located below said secondary cam surface.

* * * * *